United States Patent [19]

Koopmans

[11] 4,441,690

[45] Apr. 10, 1984

[54] DISPLACEABLE WINCH DEVICE

[76] Inventor: Luitzen B. Koopmans, No. 38a, Gelkemes, 2964 AC Groot-Ammers, Netherlands

[21] Appl. No.: 344,536

[22] Filed: Feb. 1, 1982

[30] Foreign Application Priority Data

Feb. 3, 1981 [NL] Netherlands ..... 8100506
Jul. 21, 1981 [NL] Netherlands ..... 8103443

[51] Int. Cl.[3] ..... B66D 1/26; B66D 3/00

[52] U.S. Cl. ..... 254/279; 220/1 V; 254/282; 254/295; 254/380

[58] Field of Search ..... 254/264, 278–282, 254/295, 380; 220/1 V, 1.5

[56] References Cited

U.S. PATENT DOCUMENTS

| | | | |
|---|---|---|---|
| 2,240,564 | 5/1941 | Le Tourneau | 254/281 X |
| 3,033,528 | 5/1962 | Wilson | 254/282 |
| 3,504,890 | 4/1970 | Baker | 254/282 |
| 3,781,139 | 12/1973 | Lohse | 220/1.5 X |
| 4,305,467 | 12/1981 | Villines | 254/380 |

*Primary Examiner*—John Petrakes
*Attorney, Agent, or Firm*—Peter L. Klempay

[57] ABSTRACT

The invention relates to a displaceable winch device having an external frame, a winch and a control cabin mounted inside said frame, transmission means coupled with said winch for driving the cable drum from a driving engine, for example, a Diesel engine, said frame having the dimensions and characteristics of a standardized transport container, in which the winch, the control-cabin and the driving engine are accommodated.

4 Claims, 5 Drawing Figures

DISPLACEABLE WINCH DEVICE

The invention relates to a displaceable winch device comprising an external frame, a winch mounted inside said frame, transmission means coupled with said winch for driving the cable drum from a driving engine, for example, a Diesel engine and a control-cabin formed in the frame.

In a known winch device of the kind set forth the transmission means comprise a hydraulic motor and control-means for the same, which have to be fed with the aid of a separate hydraulic driving aggregate having a hydro-pump driven by a Diesel engine. When the winch device has to be employed it has, each time, to be coupled with the aid of conduits with the driving aggregate. Displacement of this winch device is a troublesome operation because the various units and parts have to be transported separately.

The invention has for its object to provide a displaceable winch device offering improved possibilities of use.

With a displaceable winch device of the kind set forth in the preamble this object is achieved in accordance with the invention in that the frame has the dimensions and characteristics of a standardized transport container, in which the winch, the control-cabin and the driving engine are accommodated. In this way a unit is obtained in which all component parts desired and required for the operation of the winch are arranged. This unit can be readily displaced with the aid of standard transport means commonly used for transporting containers, for example, vans and ships.

A particularly advantageous embodiment of the winch device according to the invention is obtained when the winch is mounted in a winch compartment at the end of the container, the control-cabin is adjacent the winch compartment and the container comprises an engine compartment for the driving engine on the side of the control-cabin remote from the winch compartment, whilst a cooling air supply channel is arranged along the top wall of the container extending from the winch compartment to the engine compartment. The cooling air drawn in by the engine thus flows over and along the control-cabin. When the winch device is used in regions of strong solar radiation, the temperature in the control-cabin will thus never exceed that of the ambiant air. The sun rays striking the top wall of the container can thus not produce undesirably high temperature in the control-cabin. When furthermore in accordance with the invention the engine compartment is located on the end of the container remote from the winch compartment and when a tool chamber is formed between the engine compartment and the control-cabin the temperature in the tool chamber will remain tolerable. By providing a tool chamber in the winch device, the latter becomes fully "self-supporting" because all tools and parts to be actuated by the winch device, parts of the winch device itself as well as tools for any repairs will be at hand. Preferably the tool chamber will comprise a workbench.

When the winch employed in the winch device is of the type comprising two cable drums located side by side as described, for example, in Dutch application No. 81.00506, all required component parts inclusive of a tool chamber can advantageously be accommodated in a 20 feet container.

The invention will be described more fully hereinafter with reference to a preferred embodiment of the winch device in accordance with the invention, in which the frame has the dimensions of a 20-feet container.

FIG. 1 schematically illustrates the use of the device embodying the invention at a drill well.

Figure 1:
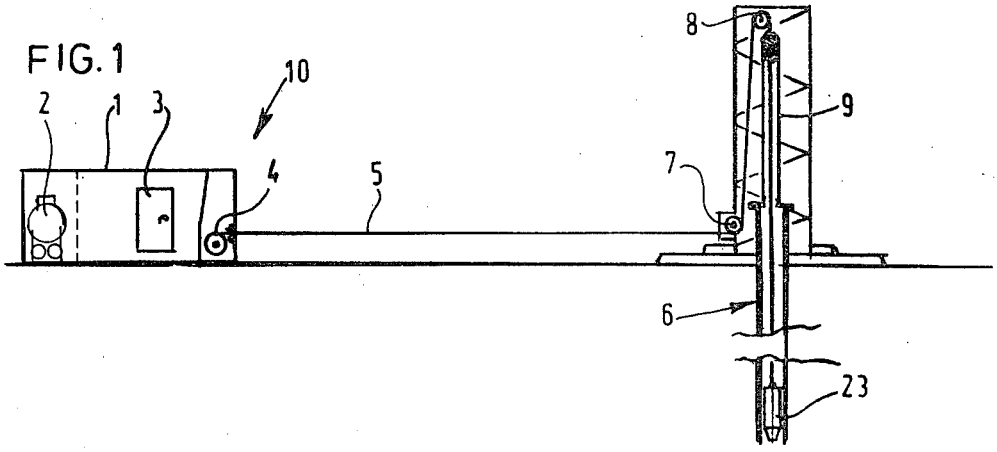

The winch device 10 comprises an external frame in the form of a container 1, which is suitable for being transported as an independent, closed unit and which comprises all accessories required for the normal operation of the winch device at any desired place. FIG. 1 only shows an oil pump aggregate 2 fed from a Diesel engine and the door 3 of the control-cabin. FIG. 1 shows only a cable drum 4 of the winch itself, along which passes a cable 5. This cable passes to the interior of a drill well 6 through a first cable disc 7 and a second cable disc 8, the latter being supported at a given distance above the drill well 6 by a post 9. A body 23 is coupled to the free end of the cable 5 inside the well 6, the behavior of the body 23 being controlled by the winch device. Since the drill well 6 itself, the associated system 7,8,9 and the body 23 do not form part of the invention either with respect th their construction or to their operation, further details thereof need not be discussed herein.

Figure 3:
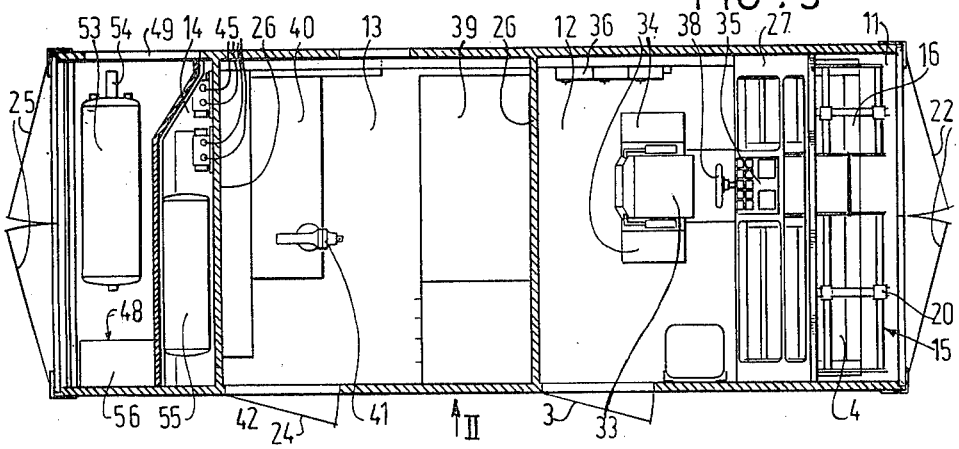
FIG. 3 is a sectional view taken on the line III—III in FIG. 2.
Figure 2:
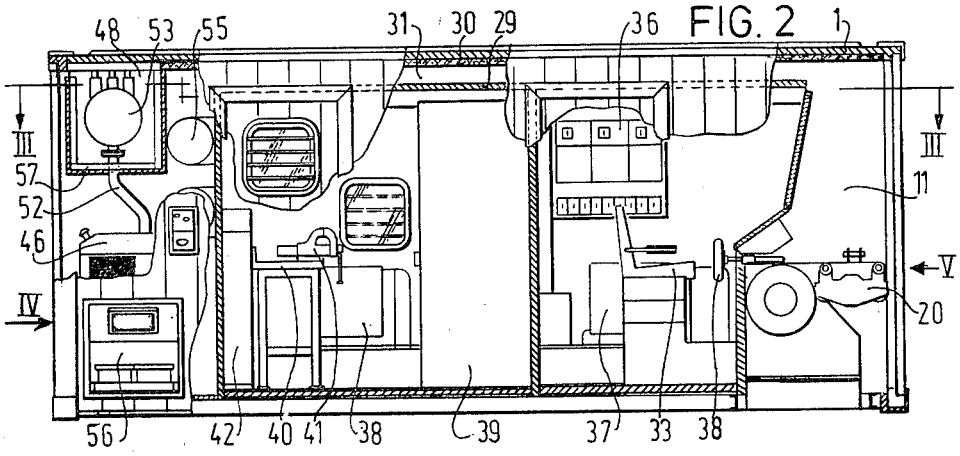
FIG. 2 is a side elevation of the device, parts of the wall being omitted.
Figure 4:
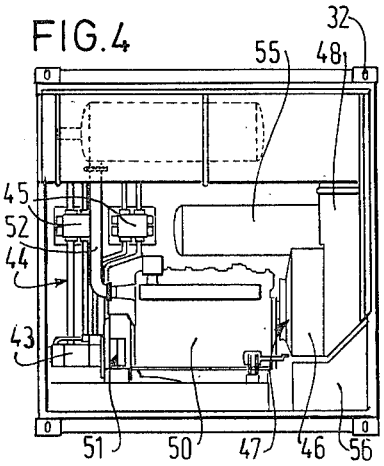
FIG. 4 is an elevational view in the direction of the arrow IV in FIG. 2, the entrance doors being omitted.
Figure 5:
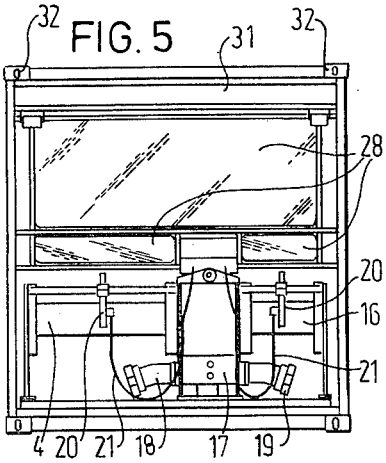
FIG. 5 is an elevational view in the direction of the arrow V in FIG. 2, the entrance doors being again omitted.

FIGS. 2 and 3 show that the container 1 is divided by partitions 26,27 into four spaces, in order to succession: a winch compartment 11, a control-cabin 12, a tool chamber 13 and an engine compartment 14. At a distance below the top wall 30 of the container 1 a ceiling wall 29 is provided for the control-cabin and the tool chamber. In this way a cooling air channel 31 is formed between the ceiling wall 29 and the top wall 30 of the container 1. The container 1 has standardized dimensions and is provided at the corners with standardized coupling members 32 so that the entire winch device 10 can be displaced like a transport container. The outer wall of the container has doors, that is to say, doors 22 in the head walls giving access to the winch compartment 11 and doors 25 leading to the engine compartment 14. A sidewall of the container 1 has a door 3 giving access to the control-cabin and a door 24 giving access to the tool chamber.

The winch compartment 11 comprises a winch 15. The winch 15 is of the type comprising two adjacent cable drums 4,16, on which cables of different types can be wound. A winch of this type is described, for example, in Dutch patent application No. 81.00506, published Sept. 1, 1982. The cable drums 4,16 can be driven through the driving gear 17 by hydro-motors 18,19. The hydro-motors 18,19 are fed from hydro-pumps coupled with the driving engine in the engine compartment 14. The winch 15 comprises cable guides 20, by which the cables are guided on the cable drums 4,16. These cable guides include sensors assessing the tractive force of the cable and the amount of paid-out cable. Through signal cables 21 these sensors are connected to an instrument panel 35 in the control-cabin 12.

The partition 27 between the winch compartment 11 and the control-cabin 12 is provided with windows 28, through which an operator sitting on the seat 33 in the control-cabin 12 can supervise the actions of the winch. The above-mentioned instrument panel 35 is disposed in front of the seat 33 and comprises instruments indicating the tractive force in the winch cable, the veered-out length of cable, the winding rates and data of the driving engine and the hydraulic system. In front of the seat 33 is furthermore mounted a steering member 38 by means of which the cable guides 20 can be displaced along the cable drums 4,16 in a manner not shown. Normally the cable guides 20 automatically move along with the winding and unwinding of the cable. If a cable tends to be incorrectly wound, the cable can be guided by displacing the cable guide 20 with the aid of the steering member 38.

The hydraulic system of the winch 15 and the driving engine 50 are controlled from control-panels 34 provided with control-members (not shown). The control-cabin 12 furthermore comprises an electric switch box 36 for the electric components of the winch device 10.

The Diesel engine 50 is arranged transversely of the container 1 in the engine compartment 14, which is readily accessible through the doors 25. With the output shaft of the Diesel engine 50 is coupled a driving gear 51, which drives two hydro-pumps 43. Each hydro-pump 43 is included through ducts 44 with one of the hydro-motors 18,19 in a circuit. In the embodiment shown of the winch device according to the invention the hydro-pumps 43 are of a reversible, controllable type, whilst the hydro-motors 18,19 are of a controllable type. In each circuit a safety arrangement 45 is included between the ducts 44 for protecting the winch against potentially detrimental consequences of pressure shocks.

For cooling the Diesel engine 50 a radiator 46 is arranged in the engine compartment, the cooling fluid of the engine 50 circulating through it. The engine 50 drives a cooling ventilator 47, which blows cooling air through the radiator 46 into the cooling air outlet channel 48. The cooling air outlet channel 48 extends upwards along a sidewall of the container and then in a transverse direction of the container 1 towards the opposite side, where an outlet grate 49 is provided and where the cooling air outlet channel 48 opens out. The walls of the cooling air outlet channel 48 are coated with damping material 57 so that also owing to the compararively large length of the cooling air outlet channel 48 the sound level outside the outlet grate 49 is low. The exhaust 52 of the engine 50 opens out in an exhaust damper 53 mounted in the cooling air channel 48. The exhaust gases leave to the damper 53 through the outlet end 54 near the outlet grate 49 and are conducted to the outside through the outlet grate 49. Owing to the large damper 53, the great length of the cooling air outlet channel 48 and the sound insulation thereof and since in addition the whole engine compartment and the cooling air supply channel 31 are provided with a sound absorbing layer, the sound level outside the container 1 is very low, when the doors 25 are shut.

As stated above the cooling air supply channel 31 extends beneath and along the top wall 30 of the container 1 between the winch compartment 11 and the engine compartment 14. Since during the operation of the device the doors 52 of the winch compartment 11 are always open, the cooling air is drawn in from the outside through the winch compartment 11.

The engine compartment 14 furthermore comprises a compressed air reservoir 55. With the engine 50 is coupled a compressor providing the compressed air. This compressed air is used inter alia for starting the engine 50.

Below the vertical part of the cooling air outlet channel 48 is formed a battery space 56. This battery space 56 is accessible from the outside.

The tool chamber 13 located between the engine compartment 14 and the control-cabin 12 comprises cabinets 38,42 for component parts and tools. In the tool chamber 13 is also arranged a work-bench 40 with a bench-vice 41.

In the tool chamber 13 and in the control-cabin 12 are arranged heat convectors 37,38 forming part of a heating system, which utilizes waste heat of the hydraulic system or of the driving engine.

What I claim is:

1. A displaceable winch device comprising an external frame, a winch mounted inside said frame and including a cable drum, a driving engine, transmission means coupled with said winch for driving said cable drum from said driving engine, and a control-cabin formed in said frame, characterised in that the frame has the dimensions and characteristics of a standardized transport container, in which the winch, the control-cabin and the driving engine are accommodated, in that the winch is mounted in a winch compartment at one end of the container, in that the control-cabin is adjacent the winch compartment and in that on the side of the control-cabin remote from the winch compartment the container comprises an engine compartment for the driving engine, whilst along the top wall of the container a cooling air supply channel extends from the winch compartment towards the engine compartment.

2. A device as claimed in claim 1, characterised in that the engine compartment is located at the end of the container remote from the winch compartment and in that a tool chamber is formed between the engine compartment and the control-cabin.

3. A device as claimed in claim 2, characterised in that a work-bench is arranged in the tool chamber.

4. A device as claimed in claim 2 or 3, in which the winch comprises two separate cable drums, characterised in that the winch is of the type having two cable drums located side by side.

* * * * *